US007302076B2

(12) United States Patent
Guenther

(10) Patent No.: US 7,302,076 B2
(45) Date of Patent: Nov. 27, 2007

(54) LOW PROFILE SPEAKER AND SYSTEM

(76) Inventor: Godehard A. Guenther, 1960 Bryant St., San Francisco, CA (US) 94110

( * ) Notice: Subject to any disclaimer, the term of this patent is extended or adjusted under 35 U.S.C. 154(b) by 0 days.

(21) Appl. No.: 11/368,361

(22) Filed: Mar. 3, 2006

(65) Prior Publication Data

US 2006/0215870 A1 Sep. 28, 2006

Related U.S. Application Data

(63) Continuation of application No. 10/715,230, filed on Nov. 17, 2003, now abandoned, which is a continuation of application No. 09/895,003, filed on Jun. 27, 2001, now abandoned.

(60) Provisional application No. 60/214,704, filed on Jun. 27, 2000.

(51) Int. Cl.
*H04R 25/00* (2006.01)

(52) U.S. Cl. ..... 381/412; 381/182; 381/414

(58) Field of Classification Search ..... 381/182, 381/396, 398, 400, 401, 412, 432, 414
See application file for complete search history.

(56) References Cited

U.S. PATENT DOCUMENTS 2,551,447 A * 5/1951 Marquis ..... 381/412
2,769,942 A 11/1956 Hassan
3,067,366 A 12/1962 Hofman
3,340,604 A 9/1967 Parain
3,838,216 A 9/1974 Watkins
3,910,374 A 10/1975 Holehouse
3,948,346 A 4/1976 Schindler
3,979,566 A 9/1976 Willy
4,122,315 A 10/1978 Schroeder et al.
4,151,379 A 4/1979 Ashworth
4,300,022 A 11/1981 Hasting-James et al.
4,401,857 A 8/1983 Morikawa
4,440,259 A 4/1984 Strohbeen
4,472,604 A 9/1984 Nakamura et al.
4,477,699 A 10/1984 Wada et al.

(Continued)

*Primary Examiner*—Suhan Ni
(74) *Attorney, Agent, or Firm*—Nutter McClennen & Fish LLP; David J. Powsner

(57) ABSTRACT

A speaker has a magnet structure mounted ahead of the speaker diaphragm to produce a shallow compact unit. The magnet structure defines a flux gap, and a voice coil residing in the flux gap is connected to a main diaphragm such that drive current applied to the voice coil moves the diaphragm to generate sound. The voice coil and magnet structure provide a flux gap at the rear of the magnet structure, ahead of and centered on the main diaphragm, while the magnet occupies space within the cone, freeing up space in the rear. In one embodiment, the magnet structure has an additional flux gap located at its forward end and the speaker includes an additional diaphragm driven by a coil positioned in the additional flux gap. The main diaphragm and additional diaphragm are better positioned to maintain a common sound center for enhanced spatial fidelity and different tuning techniques present a broad flat response below crossover to form a pinpoint sound source of wide angular coverage. The back wave couples directly into an enclosure, which may be a shallow, panel mount assembly. The magnet structure may possess an opening extending through the center of the structure allowing control over the acoustics through enclosure compliance or damping effects to enhance response of the system.

7 Claims, 4 Drawing Sheets

U.S. PATENT DOCUMENTS 4,492,826 A 1/1985 Chiu
4,552,242 A 11/1985 Kashiwabara
4,565,905 A 1/1986 Nation
4,577,069 A 3/1986 Keezer
4,737,992 A * 4/1988 Latham-Brown et al. ... 381/404
4,783,824 A 11/1988 Kobayashi
4,799,264 A 1/1989 Plummer
4,821,331 A 4/1989 Murayama et al.
4,965,837 A 10/1990 Murayama et al.
5,040,221 A 8/1991 Edwards et al.
5,115,884 A 5/1992 Falco
5,155,578 A 10/1992 Lim et al.
5,333,204 A 7/1994 Hamada et al.
5,390,257 A 2/1995 Oslac et al.
5,402,503 A 3/1995 Prokisch
5,446,797 A 8/1995 Paddock
5,519,178 A 5/1996 Ritto et al.
5,524,151 A 6/1996 Bleim
5,548,657 A 8/1996 Fincham
5,583,945 A 12/1996 Iijima et al.
5,587,615 A 12/1996 Murray et al.
5,594,805 A 1/1997 Sakamoto et al.
5,604,815 A 2/1997 Paddock
5,657,392 A 8/1997 Bouchard
5,715,324 A 2/1998 Tanabe et al.
5,744,761 A 4/1998 Ogura et al.
5,748,760 A 5/1998 Button
5,751,828 A 5/1998 Ueda et al.
5,802,189 A 9/1998 Blodget
5,802,191 A 9/1998 Guenther
5,835,612 A 11/1998 Fujihira et al.
5,847,333 A 12/1998 D'Hoogh
5,867,583 A 2/1999 Hazelwood et al.
5,898,786 A 4/1999 Geisenberger
5,909,015 A 6/1999 Yamamoto et al.
5,909,499 A 6/1999 Tanabe
5,916,405 A 6/1999 Ritto et al.
5,960,095 A 9/1999 Chang
6,005,957 A 12/1999 Meeks
6,067,364 A 5/2000 Brinkley et al.
6,208,743 B1 3/2001 Marten et al.
6,269,168 B1 7/2001 Tagami
6,359,997 B2 * 3/2002 Geisenberger et al. ..... 381/412
6,876,752 B1 * 4/2005 Guenther ..... 381/386

* cited by examiner

LOW PROFILE SPEAKER AND SYSTEM

CROSS-REFERENCE TO RELATED APPLICATION

This application is a continuation of U.S. patent application Ser. No. 10/715,230, filed Nov. 17, 2003 now abandoned, entitled "Low Profile Speaker and System," which is a continuation of U.S. Ser. No. 09/895,003, filed Jun. 27, 2001 now abandoned, which claims the benefit of priority of 60/214,704, filed Jun. 27, 2000. The teachings of all three of the above-cited applications are incorporated herein by reference.

BACKGROUND OF THE INVENTION

The present invention relates to audio speakers and systems, particularly to compact speakers and speaker/enclosure systems.

In recent years, the number of applications to which compact speakers are put has grown substantially. This growth is partly due to the arrival of numerous new forms of consumer electronics and personal electronic music playing devices, many of which require or promote the use of accessory speakers for full volume delivery of high quality sound. The increased use of compact speakers has also been fueled by a general trend toward smaller bookshelf or desktop systems, rather than the cabinet work and larger speaker enclosures that had formed the benchmark for audio performance over many decades. Changes in speaker enclosures have proceeded apace, with small speakers mounted in shells or enclosures that may themselves be panel-mounted into a wall or vehicle.

For many of these applications light weight and portability are important. For still others, cost is a major factor. For yet other applications, it may be desirable to optimize the performance of such a speaker in relation to a cabinet or other speaker housing. In such cases, detailed consideration must be given to the structure and acoustics both of the speaker and of the housing. However, the trend to small speakers poses numerous technical problems, especially at the lower frequency end of the spectrum, since a smaller diaphragm is less effective at radiating lower frequencies and, moreover, typically has a higher natural resonance. When bass response is extended or enriched by coupling to a cabinet or enclosure, the enclosure itself must often be deep or bulky. A full panoply of compensatory features, such as the use of higher drive current, longer throw coil constructions, more powerful magnet gap, improved diaphragm materials, folded horn paths and other cabinet configurations may need to be considered to achieve the desired operation in a smaller size system. Moreover, the size of the system depends on the speakers, since the size of a speaker itself may dictate the minimum dimensions physically required for its enclosure.

Another problem arises when it is desired to provide room-filling sound with a composite system, such as a stereo or surround sound system having multiple speakers or speaker diaphragms each optimized for a sub-band of the audio spectrum. In this case, when a plurality of separate instruments such as a chorus, a jazz ensemble, or a quartet are to be heard and individually discerned in the resulting sound, the problem arises that the apparent center or source of the sound may wander or jump from place to place as the pitch changes, even when the pitches had originally been produced by and recorded from the same, stationary, instrument. This problem arises in part because human auditory perception is quite sensitive to phase information, which may change as the sound emanates from different regions—speaker diaphragms or enclosure ports—of the system. This problem has been addressed to some extent by mounting various basic elements, such as a tweeter and a mid-range transducer, concentrically, so that their physical separation is only axial, and is no more than a few inches. However, the portion of sound emanating from the enclosure also contributes to this effect, making the achievement of true pinpoint sound problematic. Moreover, physical dimensions of the various magnet, frame and diaphragm structures making up a speaker or speaker system place limits on the proximity of the different sound sources.

Thus, it would be desirable to provide a speaker of improved compactness.

It would also be desirable to provide a multi-diaphragm or wide range speaker with pinpoint sound definition.

It would also be desirable to provide a housing in which the performance of a compact speaker is further enhanced.

It would also be desirable to devise such a speaker and housing, wherein the housing itself is adapted to be mounted in a cabinet, a wall space or other location as a unit, and to thereby adapt the mounting structure without extensive acoustic engineering or individualized design considerations.

SUMMARY OF THE INVENTION

One or more of these and other desirable features are attained in a speaker in accordance with the present invention wherein the speaker has a magnet structure defining a flux gap, a voice coil residing in the flux gap, and a main diaphragm connected to the voice coil such that drive current applied to the voice coil moves the diaphragm to generate sound. The main diaphragm is connected to the voice coil at a back plane and extends forward of the back plane, while the voice coil and magnet structure are centered on the main diaphragm in a location ahead of the back plane, thus forming a speaker of reduced depth. Thus, the flux gap is at the rear of the magnet structure, which is ahead of the main diaphragm. In a preferred embodiment, the magnet structure has an additional flux gap located at its forward end, and the speaker includes an additional diaphragm driven by a coil positioned in the additional flux gap. The main diaphragm and additional diaphragm may be positioned to maintain a common sound center for enhanced spatial fidelity of sound reproduction, and provide pinpoint definition free of the apparent spatial wandering that plagues wide band audio reproduction. The two diaphragms may be actuated independently, or with different bands or frequency portions of the audio signal In a preferred embodiment, the magnet structure possesses an opening extending trough the center of the structure, and when mounted in an enclosure this opening communicates with the interior of the enclosure, allowing the front diaphragm to couple with the enclosure and enhance its response. Alternatively, with no front diaphragm present, the additional opening to the enclosure may be used to affect compliance or damping of a small enclosure and enhance response of the system.

BRIEF DESCRIPTION OF THE DRAWINGS

The invention will be understood from the description herein of illustrative embodiments and comparative examples, taken together with the figures, wherein.

DETAILED DESCRIPTION OF THE INVENTION

The invention may be understood in the context of the constraints imposed in designing small, efficient, high-performance speakers and systems. Reference is hereby made to Applicant's earlier patents and patent applications as follows: U.S. Pat. No. 5,802,191, U.S. application Ser. No. 09/100,411, U.S. application Ser. No. 09/439,416 and corresponding international application PCT/US99/27011, U.S. application Ser. No. 09/639,416 and corresponding international application PCT/US00/22119. Each of the foregoing patents and applications is incorporated by reference herein in its entirety.

Figure 1:
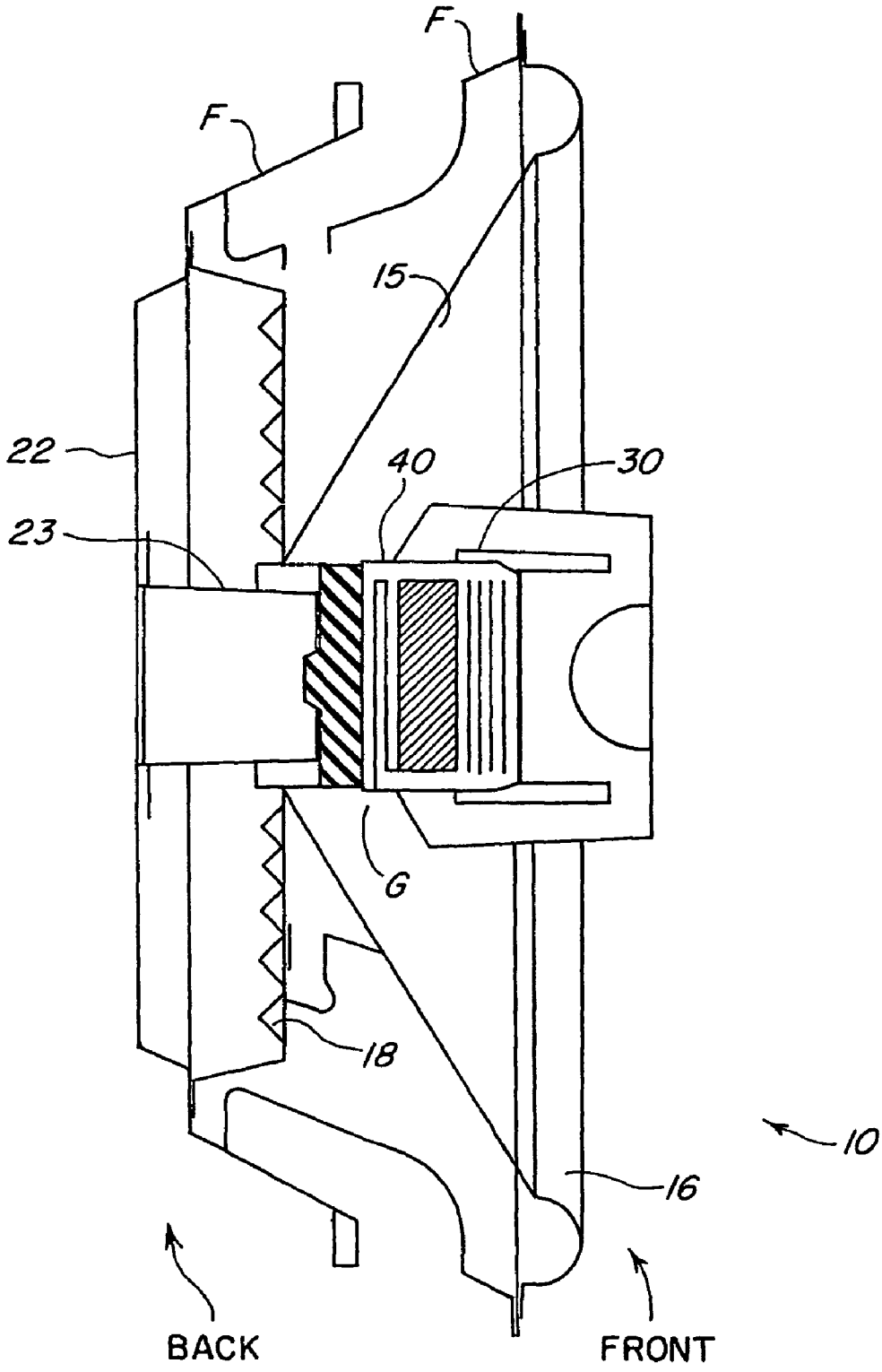
FIG. 1 illustrates a first embodiment of a compact speaker in accordance with the present invention.

FIG. 1 illustrates a diametral section through one embodiment of a speaker 10 in accordance with the present invention, showing its structure in detail. The speaker includes a diaphragm 15 (which may interchangeably be referred to herein as a "cone"), supported by a frame F. The cone faces forwardly to project sound, and the frame generally in practice extends into or mounts on an enclosure or on structure, such as a wall or panel. A magnet assembly 30 is held by the frame F in front of the diaphragm 15 and includes an arrangement of one or more active magnetic elements, e.g., permanent magnets such as neodymium magnets, and one or more shunts and pole pieces that collectively define a high flux magnetic gap G. A voice coil 40 is attached to the diaphragm, and is rides centrally in the gap G such that an audio frequency electrical drive signal applied to the voice coil moves the diaphragm 15 to generate sound. The voice coil 40 may, for example, consist of a copper or other conductive winding on a cylindrical 20 bobbin which may be formed, for example, of Kapton or other polymer sheet, stiff paper or the like. The magnet structure 30 concentrates the magnetic flux in the magnetic gap G.

Figure 2:
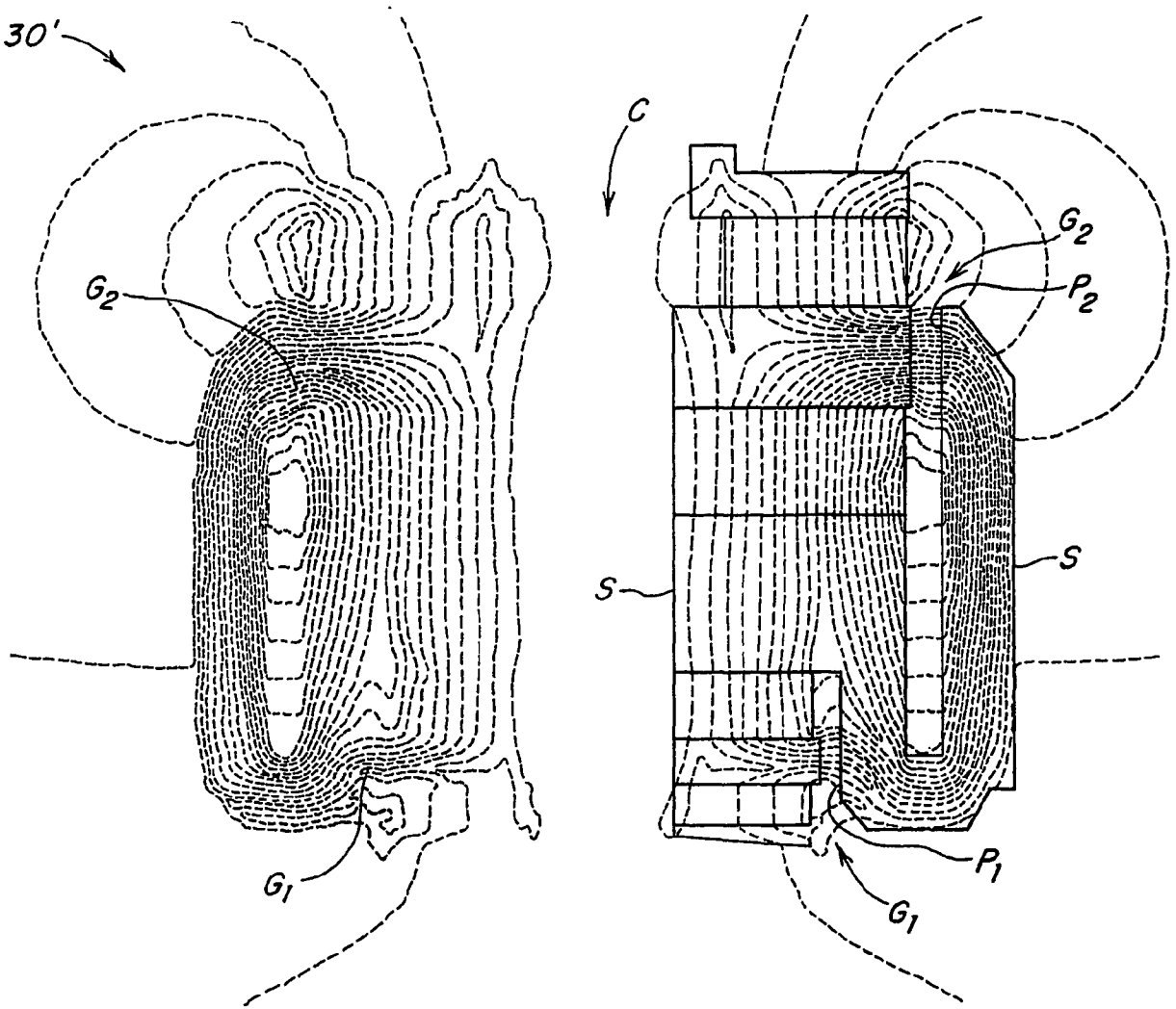
FIG. 2 shows a magnet structure and flux lines of another or further embodiment of the invention.

In accordance with a principal aspect of the present invention, the magnet structure or assembly 30 is positioned in front of the diaphragm, rather than behind it, so that the overall frame and magnet together occupy only a shallow space. In the illustrated embodiment, the magnet structure 30 resides within the overall volume already occupied by the conical diaphragm 15, adding no depth to the total structure. Without any rear magnet, the portions 22, 23 of the frame behind the diaphragm 15 may be quite shallow, serving only to support the magnet and the front frame portion. In effect, the speaker with this construction may be shallower, front to back, than a conventional speaker by an amount equal to the height or thickness of the required magnet assembly. By way of example, a subwoofer construction may have a depth of under two inches, mounting in a comparably shallow panel or enclosure For forming a coaxial speaker, the magnet assembly may be implemented as shown in FIG. 2. In this embodiment, the magnet assembly 30' is configured with an angling shunt member S that is positioned between several magnet blocks and pole piece blocks, so that in conjunction with those elements it provides two opposing pole faces P1, P2 which focus the magnetic flux into two voice coil gaps G1 and G2, respectively.

In FIG. 2, the magnet, shunt and pole piece hard metal structures are drawn as solid lines superimposed on the magnetic flux to illustrate construction of the assembly. In the illustrated embodiment, gap G2 is a deep (long throw) voice coil gap, while gap G1 is less deep. The various magnets and pole elements are ring-shaped, and there is a central opening C extending along the axis through the magnet assembly.

In accordance with another aspect of the present invention, a dual gap magnet structure 30' as described above is employed to drive a front-magnet pancake speaker as shown in FIG. 1. In this case, a second speaker diaphragm is mounted with its voice coil in the second gap of the magnet assembly. Thus, cone 15 (FIG. 1) is driven by the back gap G1 or G2, and the second diaphragm is driven by the other (front) gap G2 or G1. Thus, both diaphragms are closely positioned along the front-back axis, riding in the same magnet structure.

In this case, the front speaker element is supported by the magnet assembly itself, and does not require a mounting spider or bracket to position it in front of the back cone. The front diaphragm may be a flat diaphragm (or dome or dish) that occupies essentially a disk-shaped central region of the speaker, with its periphery attached to a perimeter region of the central magnet assembly, while the back cone extends peripherally around the center. Thus, the two diaphragms do not occlude each other. Since they are situated concentrically in a shallow region or plane, the resulting sound has pinpoint definition and remains stable over a broad spectrum.

It will be understood that a cone 15 as shown in FIG. 1 is typically suspended about its outer periphery by a flexible foam, rubber or polymer band 16 attaching it to a frame, and is centered at its rear region by another sheet or wider band of flexible but dimensionally stiff material typically 18 attached to the voice coil or to the diaphragm in the region of the voice coil to maintain centering in the magnetic gap G.

The larger, rear cone 15 may for example be a six- or eight-inch or other cone, and this may be of any desired construction, such as fiber, foamed glass epoxy, or other material. In like manner, the smaller font central diaphragm may be made of any suitable material, such as aluminum, titanium, fiber-based sheet or other material. In a preferred embodiment, it is a metal diaphragm (also referred to as a "piston" herein) that is rubber coated to increase its mass and lower its natural resonance.

Figure 3:
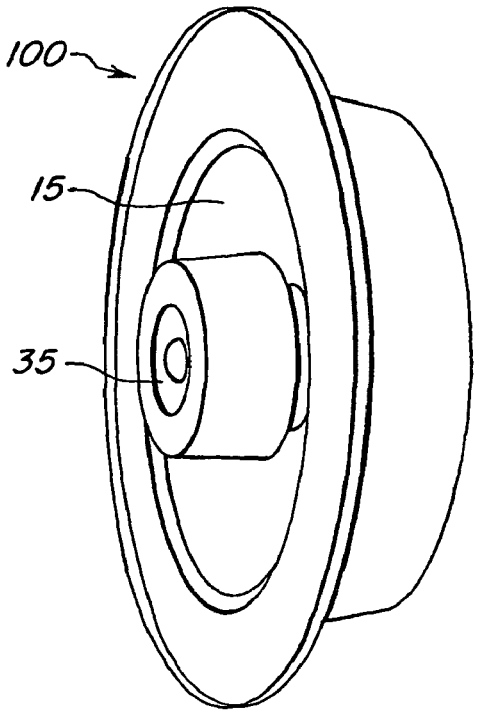
FIG. 3 illustrates the magnet structure of FIG. 2 in a dual-diaphragm pancake speaker.

FIG. 3 illustrates a two-diaphragm concentric single magnet speaker constructed in accordance with the present invention. As shown, the front mounted magnet allows the larger cone to extend substantially to the back of the speaker frame. A six-inch butyl-mounted foamed glass epoxy main cone may achieve a range of 200 Hz-20 kHz without crossover, while the small rubber coated front piston 35 of one inch diameter allows a crossover at about 280 Hz, so that all sound arrives exactly timed at the listener's ear from a point location. All fundamentals and overtones originate from the same center, within a narrow time window, and the speaker has a wide radiation pattern thus creating a large listening area.

Figure 4:
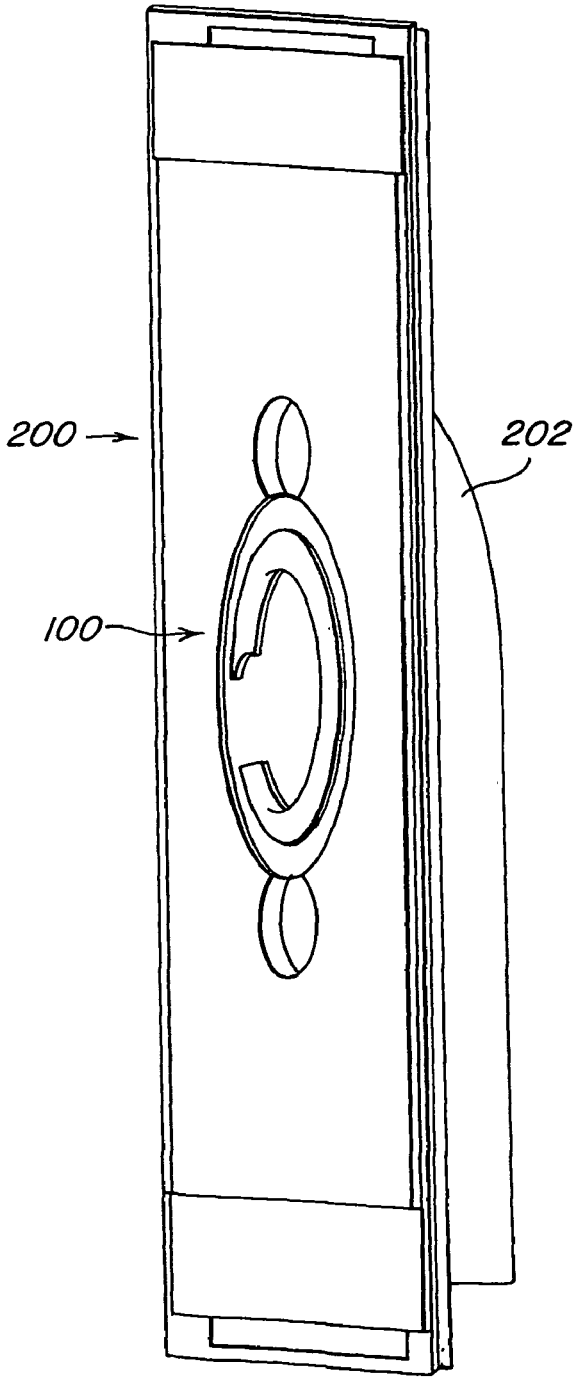
FIG. 4 illustrates the speaker of FIG. 1 in a shallow enclosure.

In accordance with a further aspect of the present invention, the shallow transducers of the present invention are mounted in a shallow enclosure to achieve an integrated system performance. For example, such an enclosure may be a molded or a hybrid metal/molded enclosure. FIG. 4 shows one embodiment 200 of such a speaker/enclosure system. As shown, the enclosure has a flat front panel 201, and has an enclosing rear body portion 202 that extends only a few inches deep, so that the unit is suitable for directly mounting over an opening in a shallow wall or divider panel. The enclosure may occupy a footprint of about 2.75 by 13.5 by 24 inches, to fit into a standard wall construction and provide an enclosure volume of about 12.5 liters. The dual gap magnet design provides an xmax of +/−5 mm, with a=/−14 mm travel.

Figure 5A:
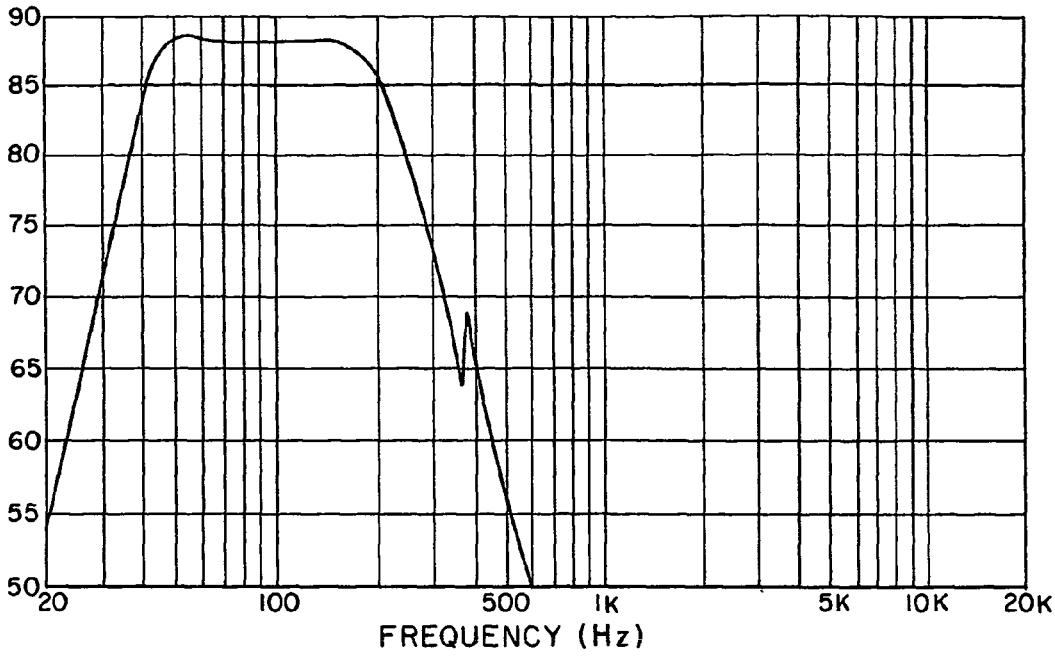
FIG. 5 frequency response and impedance of the speaker system of FIG. 4.
Figure 5B:
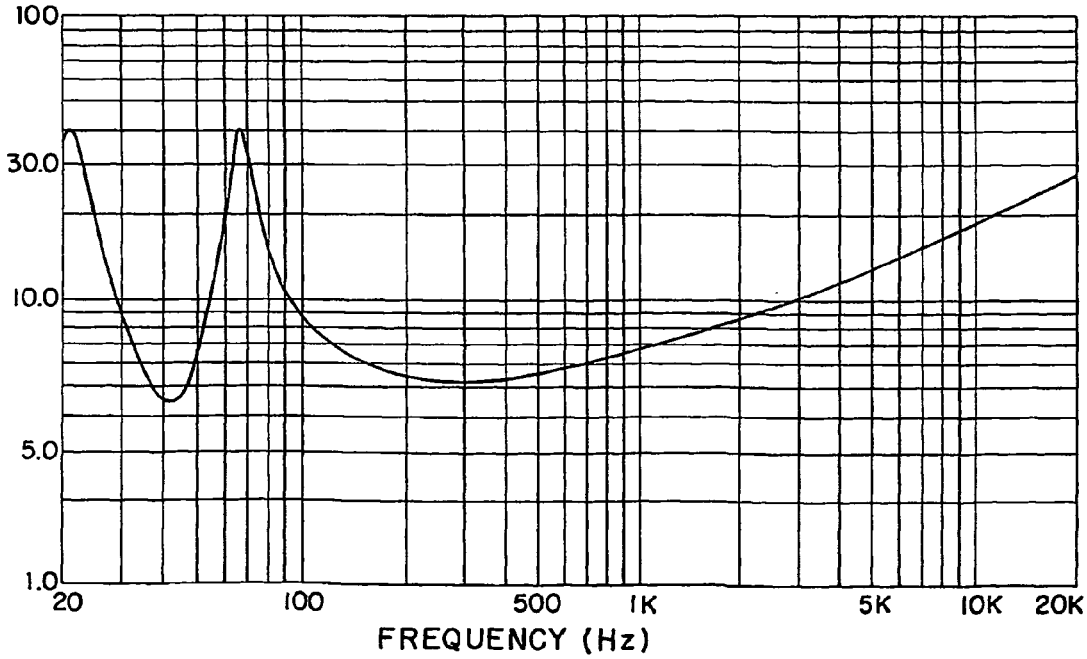

FIG. 5 shows the frequency response and impedance curves of the system of FIGS. 3 and 4. As shown in panel A, the six-inch pancake subwoofer has a flat and remarkably low frequency response. The impedance curve of panel B confirms the presence of an unusually low bass tuning at 44 Hz of the compact, internal subwoofer assembly.

Advantageously, the mounting of the magnet assembly ahead of the main cone produces not only a shallow speaker, but one free of central obstruction behind the diaphragm. The frame itself may consist of a skeletal or relatively open support structure, and the speaker is unique in having a large hole coupling the back wave to the air suspension or port of the enclosure, without the blockage or encumbrance that prior art rear-magnet constructions impose. Thus, the constructions of the present invention provide new tuning techniques to extend the range of response that may be achieved in a compact speaker or system.

The invention being thus disclosed and illustrative embodiments thereof described, further variations and modifications will occur to those skilled in the art and all such variations and modifications are considered to lie within the scope of the invention as defined by the claims appended hereto and equivalents thereof.

A more complete comprehension of the drawings hereof may be attained by reference to incorporated-by-reference application U.S. Ser. No. 09/895,003, which provides more legible versions of those drawings, which are incorporated herein by reference.

What is claimed is:

1. A speaker comprising a magnet structure comprising at least two permanent magnets, a pole assembly including at least one pole-forming element, and a shunt member disposed between said magnets, said shunt being connected between said permanent magnets and angling around to concentrate flux of said permanent magnets between pole faces forming a first flux gap positioned at a back end of said magnet structure, a first voice coil residing in the first flux gap, and a main diaphragm connected to the first voice coil such that a drive current applied to the first voice coil moves the diaphragm to generate sound, the main diaphragm being connected to the voice coil at a back portion and extending forward of the back portion, wherein the first voice coil and magnet structure are centered on the main diaphragm in a location ahead of said back portion, thereby forming a speaker of reduced depth.

2. The speaker of claim 1, wherein said magnet structure extends from a back end to a forward end, and defines a second flux gap located at the forward end the speaker including a second diaphragm driven by a second voice coil positioned in the second flux gap and located centrally ahead of the main diaphragm.

3. The speaker of claim 2, wherein the main diaphragm and second diaphragm are positioned to maintain a common sound center for enhanced spatial fidelity of sound reproduction.

4. The speaker of claim 1, wherein said diaphragm is mounted in a frame such that a back wave couples through a central opening into space behind the speaker.

5. The speaker of claim 1, further comprising an enclosure wherein the speaker is mounted in the enclosure forming a flush-mount system.

6. A speaker assembly having a speaker cone with a front interior, a voice coil connected to the speaker cone, and a magnet assembly comprising at least two permanent magnets, a pole assembly including at least one pole-forming element, and a shunt member disposed between said magnets, said shunt being connected between said permanent magnets and angling around to concentrate flux of said permanent magnets between pole faces forming a first flux gap positioned at a front of said magnet structure for driving the voice coil, wherein the magnet assembly is positioned in the front interior of the cone so that the rear of the cone is unobstructed, whereby a back wave from said cone is more effectively coupled to a ported enclosure.

7. A speaker assembly having a speaker cone with a front interior, a voice coil connected to the speaker cone, and a magnet assembly comprising at least two permanent magnets, a pole assembly including at least one pole-forming element, and a shunt member disposed between said magnets, said shunt being connected between said permanent magnets and angling around to concentrate flux of said permanent magnets between pole faces forming a first flux gap positioned at a front of said magnet structure for driving the voice coil, wherein the magnet assembly is positioned in the front in of the cone forming an assembly of reduced depth.

* * * * *